US005298696A

United States Patent [19]

Okataku et al.

[11] Patent Number: 5,298,696

[45] Date of Patent: Mar. 29, 1994

[54] ELEVATOR CAR ASSIGNMENT USING A PLURALITY OF CALCULATIONS

[75] Inventors: Yasukuni Okataku; Susumu Kubo, both of Tokyo, Japan

[73] Assignee: Kabushiki Kaisha Toshiba, Kawasaki, Japan

[21] Appl. No.: 723,070

[22] Filed: Jun. 26, 1991

[30] Foreign Application Priority Data

Jun. 29, 1990 [JP] Japan ..... 2-171417

[51] Int. Cl.[5] ..... B66B 1/18; B66B 1/14

[52] U.S. Cl. ..... 187/127; 187/121; 187/124

[58] Field of Search ..... 187/121, 127, 124, 125

[56] References Cited

U.S. PATENT DOCUMENTS 4,298,100 11/1981 Süss et al. ..... 187/126
4,363,381 12/1982 Bittar ..... 187/127
4,709,788 12/1987 Harada .
4,760,896 8/1988 Yamaguchi ..... 187/124
4,802,557 2/1989 Umeda et al. ..... 137/127
4,878,562 11/1989 Schroder ..... 187/127
4,991,694 2/1991 Friedli ..... 187/127

FOREIGN PATENT DOCUMENTS 2217046 10/1989 United Kingdom .

*Primary Examiner*—Steven L. Stephan
*Assistant Examiner*—Robert Nappi
*Attorney, Agent, or Firm*—Oblon, Spivak, McClelland, Maier & Neustadt

[57] ABSTRACT

An elevator group management system for managing a plurality of elevators is disclosed wherein the system comprises a plurality of control devices for executing overall assignment processes of the elevators in response to hall calls which take place on particular floors and a plurality of sub tasks, distributedly disposed in the control devices. for calculating times for which the elevators respond to the hall calls. When the control devices receive hall calls at the same time or nearly at the same time, they in parallel activate sub tasks distributedly disposed in the control devices and determine most suitable elevators in response to the hall calls.

6 Claims, 7 Drawing Sheets

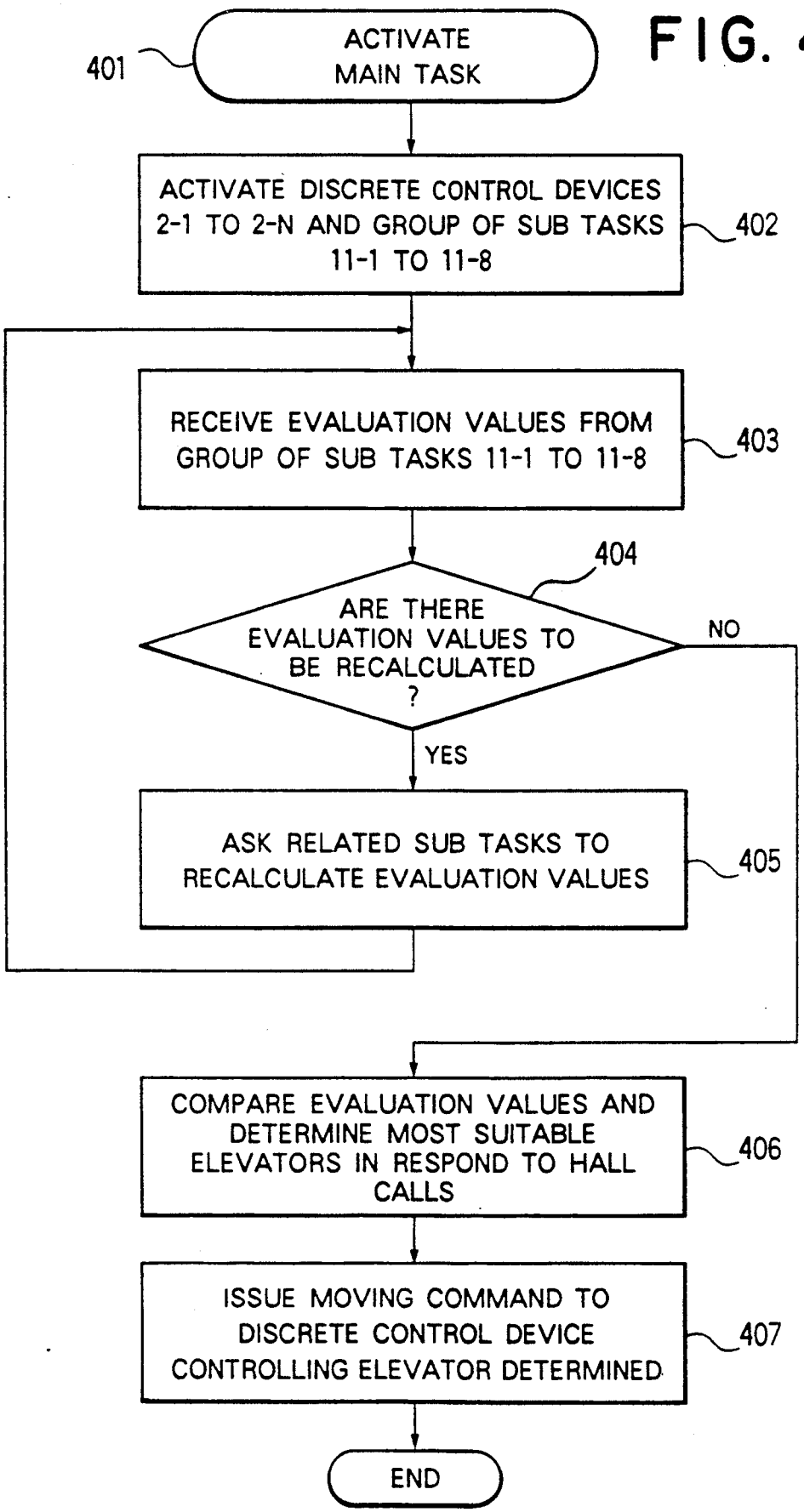
FIG. 4
401
ACTIVATE MAIN TASK
ACTIVATE DISCRETE CONTROL DEVICES 2-1 TO 2-N AND GROUP OF SUB TASKS 11-1 TO 11-8
402
RECEIVE EVALUATION VALUES FROM GROUP OF SUB TASKS 11-1 TO 11-8
403
404
ARE THERE EVALUATION VALUES TO BE RECALCULATED ?
NO
YES
ASK RELATED SUB TASKS TO RECALCULATE EVALUATION VALUES
405
COMPARE EVALUATION VALUES AND DETERMINE MOST SUITABLE ELEVATORS IN RESPOND TO HALL CALLS
406
ISSUE MOVING COMMAND TO DISCRETE CONTROL DEVICE CONTROLLING ELEVATOR DETERMINED
407
END

ELEVATOR CAR ASSIGNMENT USING A PLURALITY OF CALCULATIONS

BACKGROUND OF THE INVENTION

1. Field of the Invention

The present invention relates to an elevator group management system and an elevator assignment method for assigning a most suitable elevator from a plurality of elevators which respond to an elevator call which takes place on a particular floor (hereinafter named a "hall call").

2. Description of the Related Art

Recently, a most suitable elevator is rationally and quickly assigned from a plurality of elevators which respond to a hall call which takes place on a particular floor by means of a small computer such as a microcomputer or the like.

In addition, recently, the assignments of such elevators are controlled by using a plurality of group management control devices. An advantage of this method is that a task group for calculating a time for which each elevator responds to a hall call is distributed to a plurality of group management control devices and thereby a large number of processes can be shared by them. The task group is activated with a control command by a main task with which one of the group management control devices is provided. The main task is a task for controlling the overall assignments of the elevator group. The main task executes a process for determining an elevator which should respond to the hall call in accordance with information collected from the task group.

Nevertheless, in such an elevator group management system, as the scale of the elevator system becomes large, that is, the number of hall calls due to an increase of floors and elevators becomes large, the group management control device having main task is concentratedly loaded. Thus, when a plurality of hall calls take place nearly at the same time, the later hall calls are processed with a long time delay.

SUMMARY OF THE INVENTION

An object of the present invention is to provide an elevator group management system and elevator assignment method for assigning in parallel, where elevators respond to a plurality of hall calls which take place at the same time or nearly at the same time so as to improve the efficiency of the overall processes in the system.

To accomplish such an object, the elevator group management system for managing a plurality of elevators according to the present invention comprises a plurality of control means for executing overall assignments of the elevators in response to hall calls which take place on particular floors, and a plurality of calculation means, distributedly disposed in the plurality of control means, for individually calculating times for which the elevators respond to the hall calls, wherein the plurality of control means in parallel activate the plurality of calculation means distributedly disposed in the plurality of control means and determine the most suitable elevators in response to the hall calls in accordance with the results obtained by the plurality of calculation means when the plurality of control means receive the hall calls at the same time or nearly at the same time.

In addition, the elevator assignment method according to the present invention is the elevator assignment method for assigning a plurality of elevators by using a plurality of control means and a plurality of calculation means, distributedly disposed in the plurality of control means, for calculating times for which the plurality of elevators respond to hall calls, the method comprising the steps of a first step wherein the plurality of control means receive a plurality of hall calls which take place at the same time or nearly at the same time, a second step wherein the plurality of control means calculate times for which the plurality of elevators respond to the hall calls by using the plurality of calculation means, and a third step wherein the plurality of control means determine the most suitable elevators in response to the hall calls in accordance with the results obtained in the second step.

Thus, according to the present invention, elevators can be assigned in parallel in response to a plurality of hall calls which take place at the same time or nearly at the same time and thereby the efficiency of the overall processes in the system can be improved.

BRIEF DESCRIPTION OF DRAWINGS

FIG. 4 is a flow chart showing a process flow of assignments of elevators;

DESCRIPTION OF PREFERRED EMBODIMENT

Now, with reference to the accompanying drawings, an embodiment of the present invention will be described.

Figure 1:
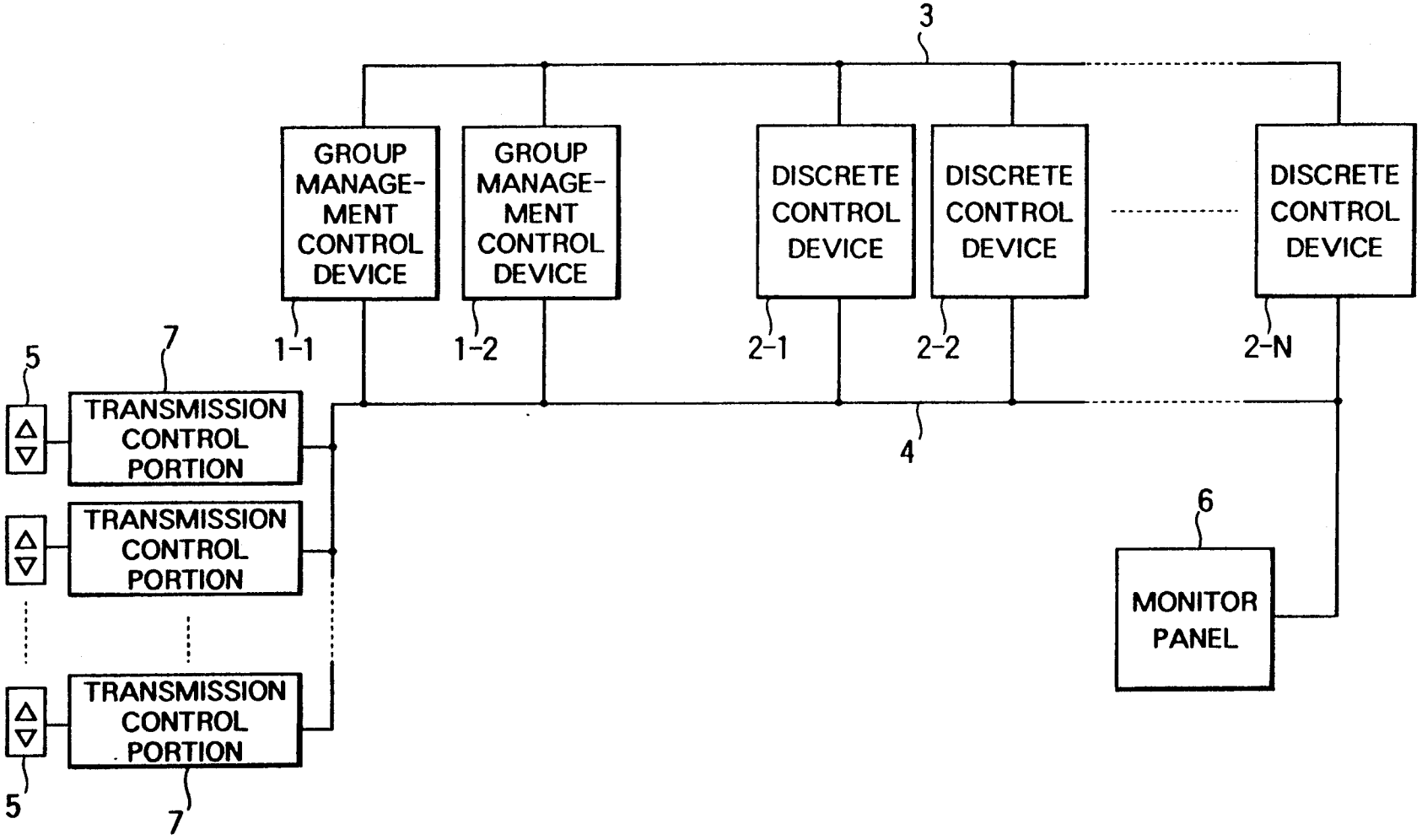
FIG. 1 is a block diagram showing the overall construction of an elevator group management system of an embodiment according to the present invention.

FIG. 1 is a block diagram describing the overall construction of an elevator group management system of an embodiment according to the present invention.

In the FIGURE, the reference numerals 1-1 and 1-2 are group management control devices for managing an elevator group. The reference numerals 2-1 to 2-N are a plurality of discrete control devices for individually controlling an elevator. The group management control devices 1-1 and 1-2 and the discrete control devices 2-1 to 2-N are composed of small computers which use a single or a plurality of microcomputers. The group management control devices 1-1 and 1-2 and the discrete control devices 2-1 to 2-N are mutually connected through a high speed transmission line 3 and a low speed transmission line 4. The high speed transmission line 3 is used to exchange information necessary for managing the elevator group among the group management control devices 1-1 and 1-2 and the discrete control devices 2-1 to 2-N. The low speed transmission line 4 is used to transfer information among the group management control devices 1-1 and 1-2, the discrete control devices 2-1 to 2-N, a hall call button 5 on each floor, a monitor panel 6 in a monitor room, and so forth. Each hall call button 5 is connected to the low speed transmission line 4 through a transmission control device 7.

Figure 2:
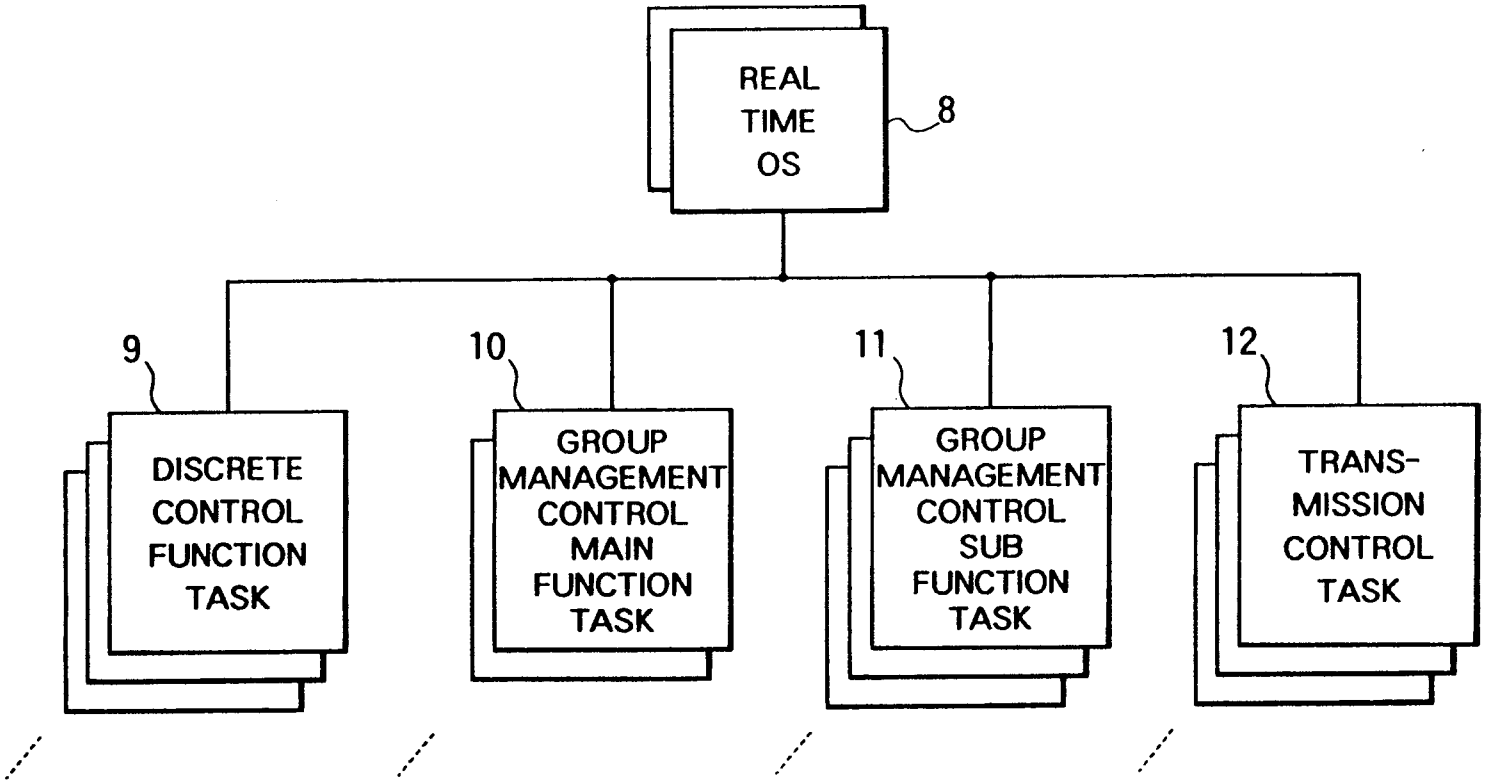
FIG. 2 is a block diagram describing the overall construction of software in the elevator group management system shown in FIG. 1.

FIG. 2 is a block diagram showing the overall construction of software with which the elevator group management system is provided.

As shown in the FIGURE, a real time OS 8, which is an operating system, controls the activation and stoppage or a discrete control function task 9, a group management control main function task (hereinafter named the main task) 10, a group management control sub function task (hereinafter named a sub task) 11, and a transmission control task 12.

The discrete control function task 9 is used to control the discrete control devices 2-1 to 2-N.

The sub task 11 executes a process for calculating a time for which each elevator responds to a hall call, that is, an evaluation value with respect to a time necessary for moving the elevator to the floor on which the hall call takes place in accordance with a particular evaluation equation. The number of sub tasks 11 is the same as that of elevators.

The main task 10 is used to execute an overall assignment process of the elevator group. In other words, when a hall call takes place, the main task 10 activates all the sub tasks 11 and executes the process for determining a most suitable elevator in response to the hall call in accordance with an evaluation value obtained by each sub task 11.

The transmission control task 12 is a task for controlling information transmitted between the group management control devices 1-1 and 1-2.

Figure 3:
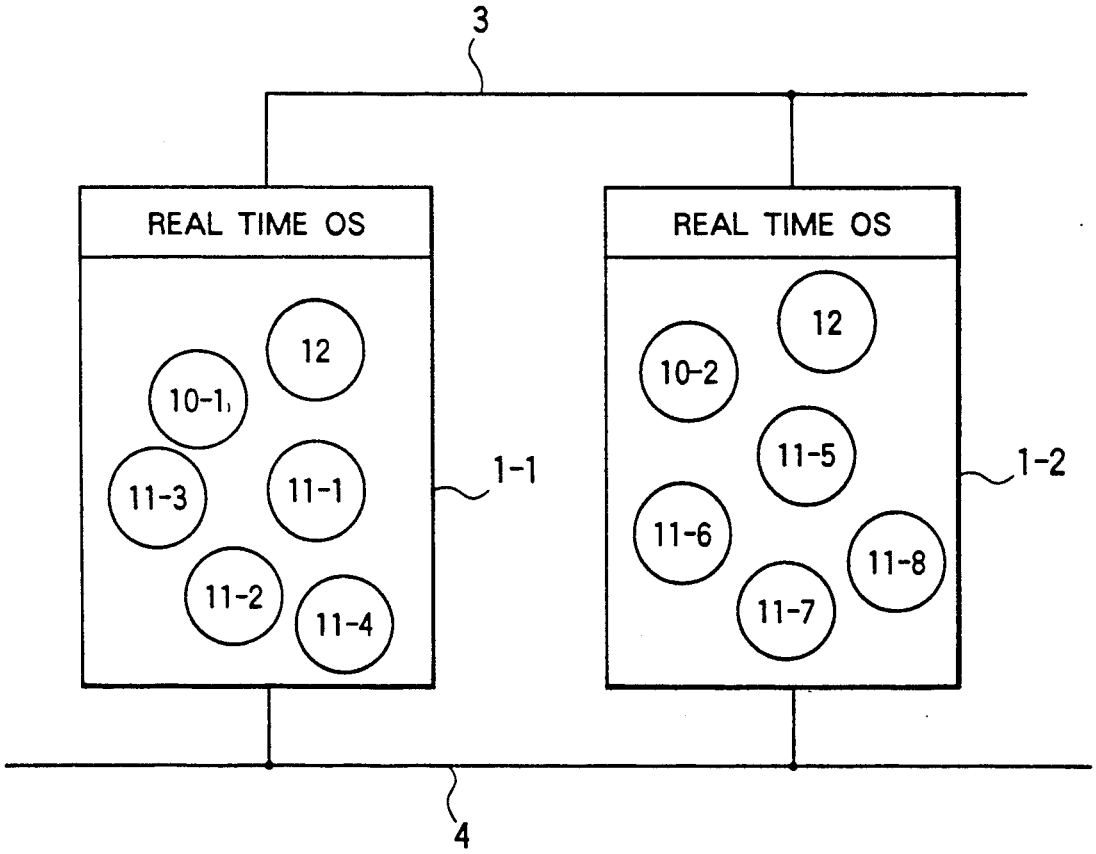
FIG. 3 is a block diagram showing an example of allocation of each task in each group management control device.

FIG. 3 is a schematic showing an example of allocation of each task in the group management control devices 1-1 and 1-2.

As shown in the FIGURE, the one group management control device 1-1 is provided with the main task 10-1, the four sub tasks 11-1 to 11-4, and the transmission control task 12. On the other hand, the other group management control device 1-2 is provided with the main task 10-2, the four sub tasks 11-5 to 11-8, and the transmission control task 12. In other words, the sub tasks 11-1 to 11-8 are distributed to the group management control devices 1-1 and 1-2.

Then, with reference to FIG. 4, the operation of the elevator group management system will be described.

When a hall call takes place, the group management control device 1-1 or 1-2 which is not executing the main task 10 receives the hall call and activates the main task 10 (in the step 401). When both the group management control devices 1-1 and 1-2 are not executing the main task 10, the predetermined group management control device 1-1 receives the hall call.

The main task 10-1 sends an activation command to the discrete control devices 2-1 to 2-N and activates all the sub tasks in the group management control devices 1-1 and 1-2 (in the step 402).

Each of the sub tasks 11-1 to 11-8 receives information from the discrete control function task 9 of each of the discrete control devices 2-1 to 2-N and thereby knowing the present position of the elevator. Thereafter, each of the sub tasks 11-1 to 11-8 calculates an evaluation value with respect to a time for which the elevator responds to the hall call. Each of the sub tasks 11-1 to 11-8 sends the calculated evaluation value to the main task 10-1 of the group management control device 1-1.

When the main task 10-1 receives all the evaluation values from all the sub tasks 11-1 to 11-8 (in the step 403), it checks whether or not there are evaluation values which should be recalculated (in the step 404). In other words, the main task 10-1 monitors elevators which are assigned in response to other hall calls while collecting all the evaluation values. If such elevators are present, the main task 10-1 treats the evaluation values which have been received as those to be recalculated.

When the main task 10-1 detects that there are evaluation values to be recalculated, it cancels the evaluation values and then requests the sub tasks 11 which calculated them to recalculate evaluation values (in the step 405).

After the main task 10-1 has received all correct evaluation values from all the sub tasks 11-1 to 11-8, it compares all the evaluation values, determines a most suitable elevator in response to the hall call (in the step 406), and issues a movement command to the discrete control device 2-1 to 2-N which controls the elevator (in the step 407).

While the main task 10-1 of the group management control device 1-1 is assigning an elevator, if another hall call takes place, the main task 10-2 of the other group management control device 1-2 is activated. Likewise, the main task 10-2 assigns an elevator by using the sub tasks 11-1 to 11-8 which have been used by the main task 10-1.

Figure 5:
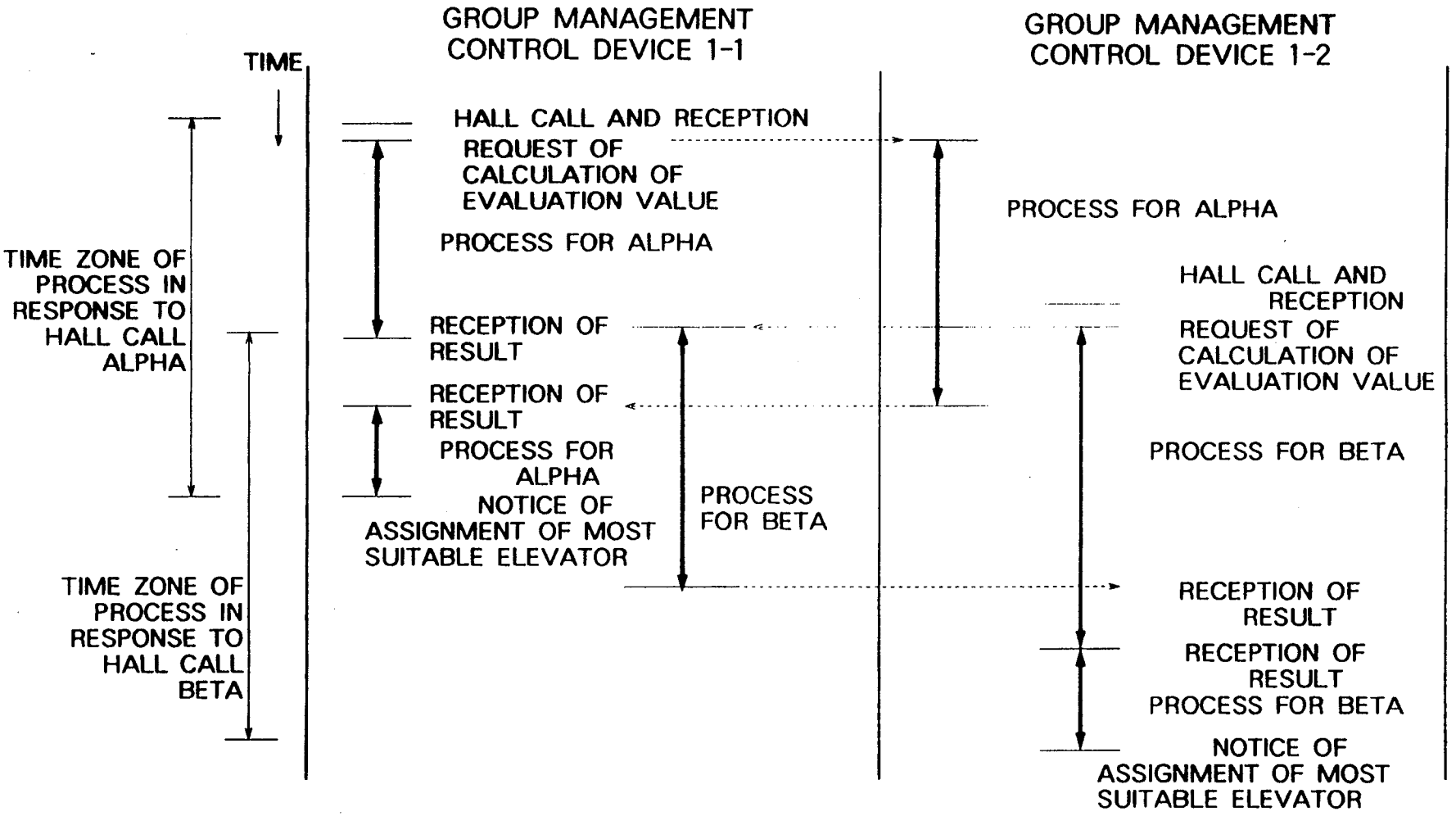
FIG. 5 is a schematic showing timings of parallel assignment processes of elevators in response to two hall calls.

FIG. 5 is a schematic showing timings of a process for assigning elevators in response to two hall calls Alpha and Beta which take place with a small time delay.

As described above, in this elevator group management system, the process for assigning elevators in response to two hall calls Alpha and Beta which take place nearly at the same time can be executed in parallel without a time delay and thereby the elevators can be effectively assigned.

In this elevator group management system, the following process is also executed.

For example, it is assumed that the number of available elevators is limited depending on the time zone. When the group of the sub tasks 11 according to available elevators is concentrated on the one group management control device, the load is concentrated thereon.

Figure 6:
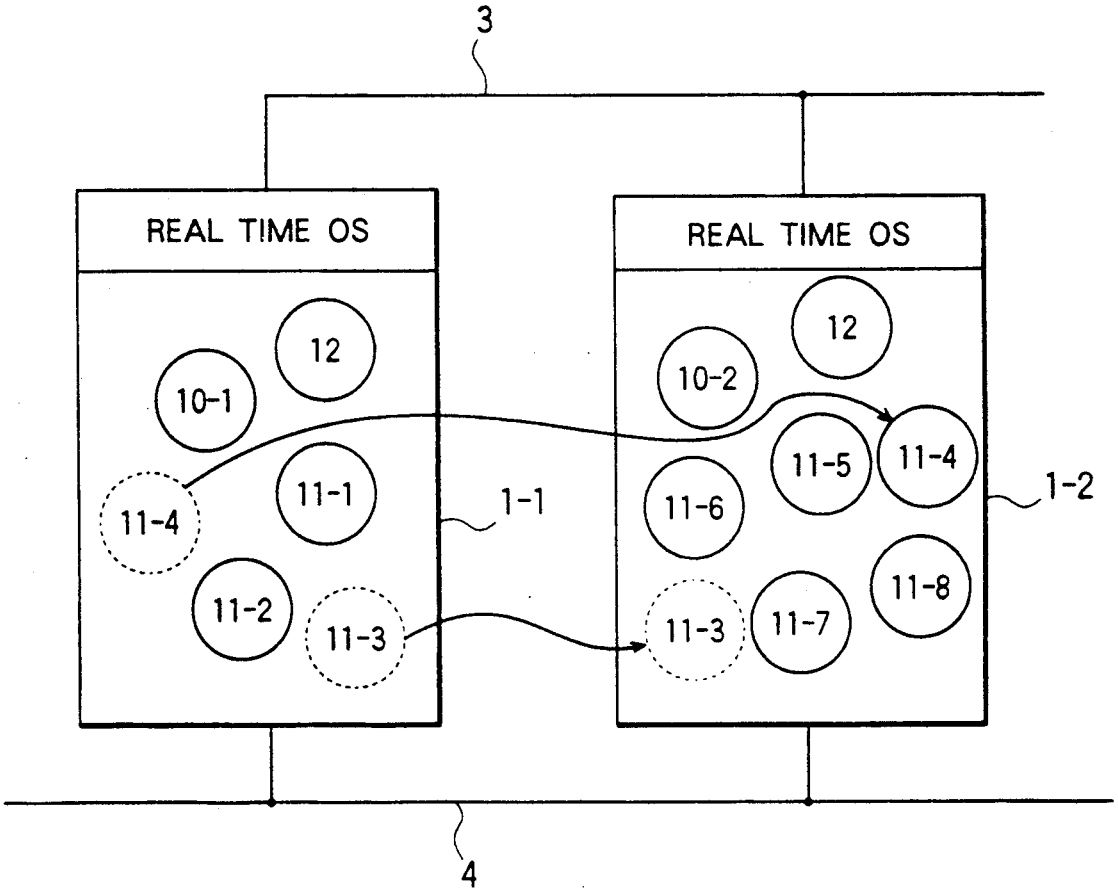
FIG. 6 is a block diagram showing a sub task transfer process executed between the group management control devices.

In this case, as shown in FIG. 6, part of the sub tasks 11-3 and 11-4 allocated in the group management control device 1-1 on which the load is concentrated are automatically transferred to the other group management control device 1-2.

Figure 7:
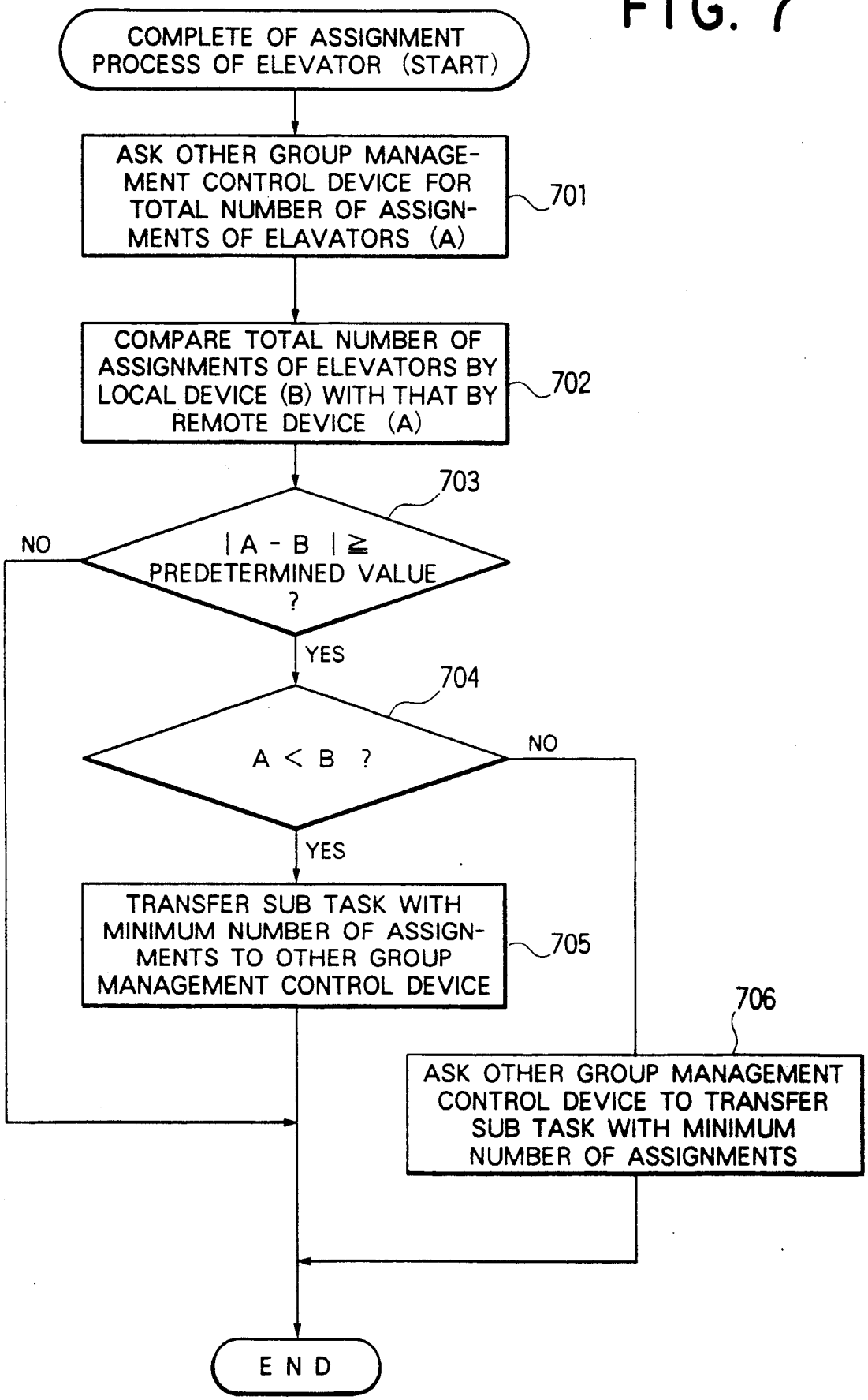
FIG. 7 is a flow chart showing a process for transferring a sub task.

Then, with reference to FIG. 7, this sub task transfer process will be described.

Each of the group management control devices 1-1 and 1-2 stores the total number of assignments of the elevators according to the sub tasks 11 controlled thereby and the number of assignments of each elevator.

The one group management control device 1-1 which completed the elevator assignment process of an elevator in response to a hall call asks the other group management control device 1-2 for the total number of assignments of elevators by itself up to that time (A) (in the step 701).

Thereafter, the group management group control device 1-1 compares the total number of assignments of elevators by itself (B) with the total number of assignments by the other group management control device 1-2 (A) (in the step 702). When the group management control device 1-1 determines that the absolute value of the difference between the two values ( $|A - B|$) exceeds a predetermined value (in the step 703) and that the total number of assignments by itself (B) is greater than the total number of assignments by the other group management control device 1-2 (A) (in the step 704), it transfers the sub task 11 with the smallest number of assignments in the group of those thereof to the other group management control device 1-2 (in the step 705).

When the group management control device 1-1 determines that the absolute value of the difference of the two values ( $|A - B|$) exceeds the predetermined value (in the step 703) an that the total number of assignments by itself (B) is smaller than the total number of assignments by the other group management control device 1-2 (A) (in the step 704), it asks the other group management control device 1-2 to transfer the sub task 11 with the smallest number of assignments in those thereof (in the step 706).

This process is repeatedly executed whenever each of the group management control devices 1-1 and 1-2 completes the elevator assignment process.

As was described above, according to the elevator group management system according to the present invention, the elevator assignment processes in response to two hall calls which take place at the same time or nearly at the same time can be executed in parallel without a time delay and thereby the assignment processes of the elevator group can be effectively executed.

In the elevator group management system, when the number of available elevators is limited, the load concentration on the group management control devices 1-1 and 1-2 can be prevented.

What is claimed is:

1. An elevator group management system for managing a plurality of elevators, comprising:

a plurality of control means for executing overall assignments of said elevators in response to hall calls which take place on particular floors;

a plurality of calculation means, distributively disposed in said plurality of control means, for individually calculating times required for said plurality of elevators to respond to said hall calls;

wherein a first of said plurality of control means responds to a first hall call and activates a first calculation means disposed in said first control means to determine a most suitable elevator to respond to said first hall call;

wherein a second of said plurality of control means responds to a second hall call, only when the second hall call is received subsequent to the first hall call and while the first of said plurality of control means is responding to said first hall call, and activates a second calculation means disposed in said second control means to determine a most suitable elevator to respond to said second hall call; and dispatching means for dispatching the most suitable elevators to respond to said first and second hall calls as calculated by the respective first and second calculation means.

2. An elevator group management system for managing a plurality of elevators, comprising:

first and second control means for executing overall assignments of said plurality of elevators in accordance with hall calls which take place on particular floors;

first and second calculation means distributively disposed in said first and second control means, for individually calculating times required for said plurality of elevators to respond to said hall calls;

wherein a first of said first and second control means responds to a first hall call and activates the first calculation means disposed in said first control means to determine a most suitable elevator to respond to said first hall call;

wherein a second of said plurality of control means responds to a second hall call, only when the second hall call is received subsequent to the first hall call and while the first control means is responding to said first hall call, and activates the second calculation means disposed in said second control means to determine a most suitable elevator to respond to said second hall call; and dispatching means for dispatching the most suitable elevators to respond to said first and second hall calls as calculated by the respective first and second calculation means.

3. An elevator group management system for managing a plurality of elevators, comprising:

first and second control means for executing overall assignments of said plurality of elevators in accordance with hall calls which take place on particular floors;

first and second calculation means distributively disposed in said first and second control means, for individually calculating times required for said plurality of elevators to respond to said hall calls, wherein said first and second calculations means calculate times required for said plurality of elevators to respond to said hall calls by calculating a plurality of subfunctions;

record means for recording a total number of subfunctions to be calculated by said first and second calculation means disposed in said first and second control means as loads thereof;

transfer means for transferring part of said subfunctions to be calculated between the first and second calculation means disposed in one of said first and second control means with a large load to the other of said first and second control means when the difference of each total number of subfunctions recorded by said record means exceeds a predetermined value;

wherein a first of said first and second control means responds to a first hall call and activates the first calculation means disposed in said first control means to determine a most suitable elevator to respond to said first hall call;

wherein a second of said first and second control means responds to a second hall call, received subsequent to the first hall call and while the first control means is responding to said first hall call, and activates the second calculation means disposed in said second control means to determine a most suitable elevator to respond to said second hall call; and dispatching means for dispatching the most suitable elevators to respond to said first and second hall calls as calculated by the respective first and second calculation means.

4. A method for managing a plurality of elevators in an elevator group management system in response to a plurality of hall calls, comprising the steps of:

receiving, at each of a plurality of control means, the plurality of hall calls;

calculating, in a plurality of calculation means, distributively disposed in said plurality of control means, response times required for said plurality of elevators to respond to said plurality of hall calls;

determining, in said plurality of control means, most suitable elevators to respond to said hall calls based on said calculated response times;

wherein a first of said plurality of control means responds to a first hall call and activates the first calculation means disposed in said first control means to determine a most suitable elevator to respond to said first hall call;

wherein a second of said plurality of control means responds to a second hall call, only when the second hall call is received subsequent to the first hall call and while the first of said plurality of control means is responding to said first hall call, and activates a second calculation means disposed in said second control means to determine a most suitable elevator to respond to said second hall call; and dispatching the most suitable elevators to respond to said first and second hall calls as calculated by the respective first and second calculation means.

5. A method for managing a plurality of elevators in an elevator group management system in response to a plurality of hall calls, comprising the steps of:

receiving, at each of first and second control means, the plurality of hall calls;

calculating, in first and second calculation means, distributively disposed in said first and second control means, response times required for said plurality of elevators to respond to said plurality of hall calls;

determining, in said first and second control means, most suitable elevators to respond to said hall calls based on said calculated response times;

wherein a first of said first and second control means responds to a first hall call and activates the first calculation means disposed in said first control means to determine a most suitable elevator to respond to said first hall call;

wherein a second of said first and second control means responds to a second hall call, only when the second hall call is received subsequent to the first hall call and while the first control means is responding to said first hall, and activates the second calculation means disposed in said second control means to determine a most suitable elevator to respond to said second hall call; and dispatching the most suitable elevators to respond to said first and second hall calls as calculated by the respective first and second calculation means.

6. A method for managing a plurality of elevators in an elevator group management system in response to a plurality of hall calls, comprising the steps of:

receiving, at each of first and second control means, the plurality of hall calls;

calculating, in first and second calculation means, distributively disposed in said first and second control means, response times required for said plurality of elevators to respond to said plurality of hall calls, wherein said first and second calculations means calculate times required for said plurality of elevators to respond to said hall calls by calculating a plurality of subfunctions;

determining, in said first and second control means, most suitable elevators to respond to said hall calls based on said calculated response times;

recording a total number of subfunctions to be calculated by said first and second calculation means disposed in said first and second control means as loads thereof;

transferring part of said subfunctions to be calculated between the first and second calculation means disposed in one of said first and second control means with a large load to the other of said first and second control means when the difference of each total number of subfunctions recorded by said record means exceeds a predetermined value;

wherein a first of said first and second control means responds to a first hall call and activates the first calculation means disposed in said first control means to determine a suitable elevator to respond to said first hall call;

wherein a second of said first and second control means responds to a second hall call, received subsequent to the first hall call and while the first control means is responding to said first hall, and activates the second calculation means disposed in said second control means to determine a most suitable elevator to respond to said second hall call; and dispatching the most suitable elevators to respond to said first and second hall calls as calculated by the respective first and second calculation means.

* * * * *

UNITED STATES PATENT AND TRADEMARK OFFICE

CERTIFICATE OF CORRECTION

PATENT NO. : 5,298,696

DATED : March 29, 1994

INVENTOR(S) : Yasukuni OKATAKU, et al.

It is certified that error appears in the above-indentified patent and that said Letters Patent is hereby corrected as shown below:

ON THE TITLE PAGE

In the ABSTRACT, section [57], line 7, change "devices. for" to --devices, for--.

Column 8, line 15, change "calculations" to --calculation--;

line 41, after "hall" insert --call--.

Signed and Sealed this

Fourth Day of July, 1995

Bruce Lehman

*Attest:*

BRUCE LEHMAN

*Attesting Officer*

*Commissioner of Patents and Trademarks*